United States Patent [19]

Lancaster et al.

[11] 4,429,514

[45] * Feb. 7, 1984

[54] ROTATABLE STRETCHING APPARATUS WITH PRESTRETCHING MECHANISM

[75] Inventors: William G. Lancaster, Louisville; Patrick R. Lancaster, III, Anchorage, both of Ky.

[73] Assignee: Lantech, Inc., Louisville, Ky.

[ * ] Notice: The portion of the term of this patent subsequent to Dec. 1, 1998 has been disclaimed.

[21] Appl. No.: 254,415

[22] Filed: Apr. 15, 1981

Related U.S. Application Data

[63] Continuation-in-part of Ser. No. 96,384, Nov. 21, 1979, Pat. No. 4,302,920.

[51] Int. Cl.[3] ..... B65B 11/02

[52] U.S. Cl. ..... 53/556; 53/210; 53/588

[58] Field of Search ..... 53/210, 556, 587, 588

[56] References Cited

U.S. PATENT DOCUMENTS

| | | | |
|---|---|---|---|
| 2,563,542 | 8/1951 | Mackelduff | 53/588 X |
| 2,854,697 | 10/1958 | Ryan . | |
| 2,945,336 | 7/1960 | Anderson | 53/588 |
| 4,079,565 | 3/1978 | Lancaster et al. | 53/556 X |
| 4,166,348 | 9/1979 | Carlson | 53/556 |
| 4,178,739 | 12/1979 | DuBroff | 53/588 |
| 4,282,700 | 8/1981 | Gordstein | 53/588 X |
| 4,283,903 | 8/1981 | Mayhall | 53/587 |
| 4,302,920 | 12/1981 | Lancaster et al. | 53/587 X |
| 4,336,679 | 6/1982 | Lancaster et al. | 53/465 X |

FOREIGN PATENT DOCUMENTS

| | | | |
|---|---|---|---|
| 2281275 | 4/1976 | France | 53/556 |
| 52-15791 | 2/1977 | Japan | 53/556 |

*Primary Examiner*—John Sipos

*Attorney, Agent, or Firm*—Gipple & Hale

[57] ABSTRACT

The present invention is directed toward an apparatus for making a package from a load using a single web of stretchable film material to form the overwrap. The apparatus comprises a frame, a support assembly secured to and extending from the frame, and a film dispenser mechanism rotatably mounted to the support assembly. The film dispenser mechanism comprises an arm member, a counterbalance weight on one end of the arm member, and a film stretching mechanism mounted on the other end of the arm member adjacent to a roll of stretchable film material which is also mounted on the arm member. The film stretching mechanism is constructed with two rollers closely spaced apart and mechanically connected, with the upstream roller being driven by a drive member mounted to it or its shaft. The drive member engages the downstream roller to drive the upstream roller slower than the downstream roller causing film material which is being pulled from the roll of film material to be wrapped around a load carried on the support assembly so that the load is wrapped with a plurality of layers of prestretched tensioned film material to form a wrapped tensioned package.

33 Claims, 10 Drawing Figures

Fig. 1
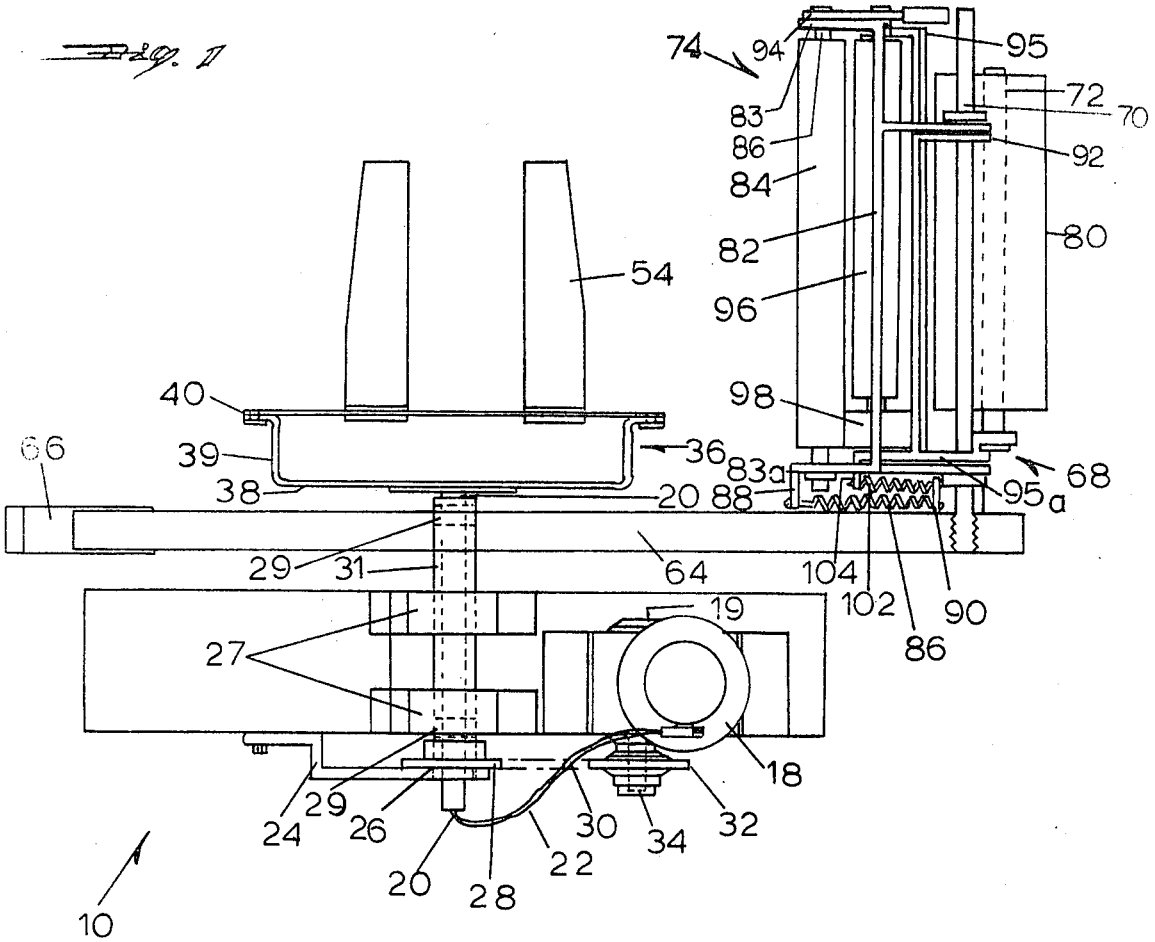
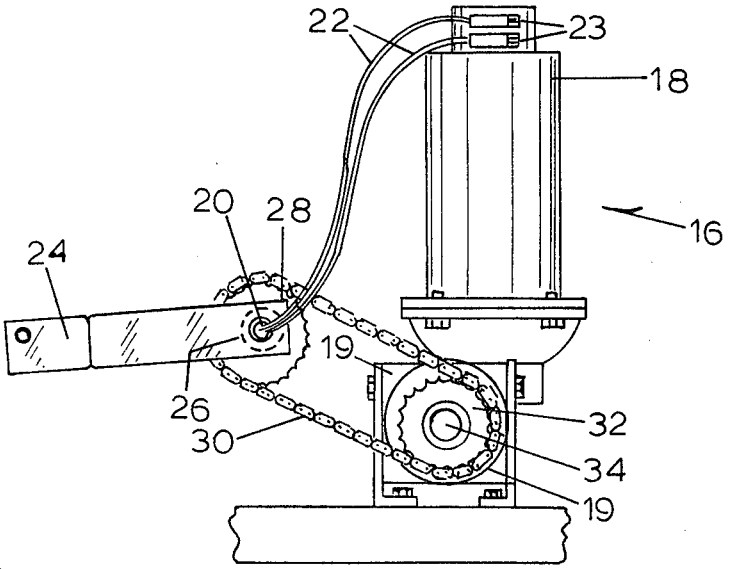
Fig. 2

Fig. 3
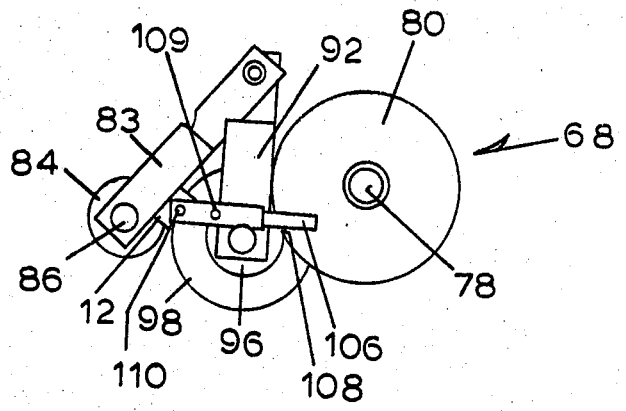
Fig. 4
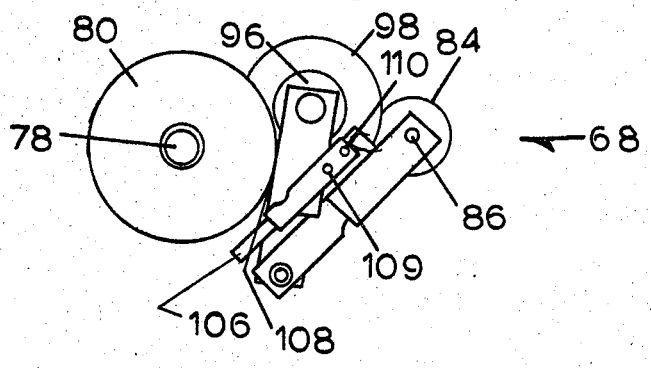
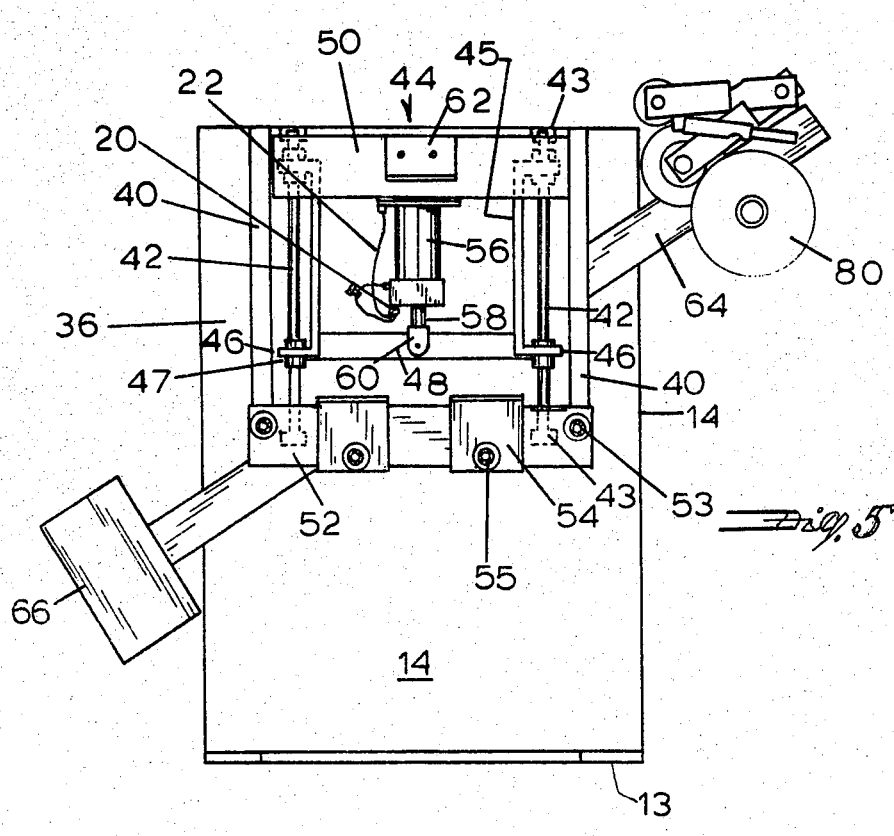
Fig. 5

ROTATABLE STRETCHING APPARATUS WITH PRESTRETCHING MECHANISM

RELATED APPLICATIONS

This is a continuation-in-part application of application Ser. No. 096,384 filed Nov. 21, 1979 entitled "Film Web Drive Stretch Wrapping Apparatus and Process" now U.S. Pat. No. 4,302,920.

BACKGROUND OF THE INVENTION

The present invention generally relates to packaging and more particularly to an apparatus for making a package wrapped in a web of stretched film.

Case packing or boxing is a common way of shipping products. The products are generally stacked in a corrugated box or are wrapped with kraft paper with the end of the kraft paper being glued or taped. Another way of shipping such products is by putting a sleeve or covering of heat shrinkable film around the products and shrinking the sleeve to form the unitized package.

Within the last five years, conventional packaging has significantly changed with the use of stretch film systems which wrap stretched film web around the load to hold the load in a tensioned unitized state. This efficient, commonly used packaging technique wraps the load with a single web of stretched plastic film web. This packaging is generally accomplished with apparatus commonly referred to as "full web wrapping" machinery, "spiral wrapping" machinery and "ring wrapping" machinery.

An early full web wrapping device which wraps stretched film around a rotating load carried by a turntable is described in U.S. Pat. No. 3,867,806. In this reference, an initial portion of the film wrap is placed on the load under a reduced tension and in a substantially unstretched state with the rest of the wrap being placed under an increased tension so that the film web is substantially stretched around the load to hold the package under compressive forces.

The use of spiral wrapping machinery is also well known in the art. A typical apparatus is shown by U.S. Pat. No. 3,863,425 in which film is guided from the roll and wrapped around a cylindrical load in a spiral configuration. A carriage drives the film roll adjacent the surface of the load and deposits a spiral wrap around the load and returns in the opposite direction to deposit another spiral wrap around the load.

An early rotary type mechanism which rotates the film roll around a substantially stationary load to wrap the load with a stretched full web is shown in U.S. Pat. No. 4,079,565. In this reference, an arm carrying a film dispensing roll is rotatably mounted on a frame. The arm is rotatably driven by a motor so that the film roll carried on the distal end of the arm is transported around a stationary load supported by the tines of a fork truck, the load having previously been inserted into the wrapping area by positioning the load and fork truck tines within the wrapping area. In operation of the apparatus, the leading edge of the film web is pulled from the film roll by the operator and tucked into the fork truck load. The machine is activated by the operator and a plurality of full web wraps of stretched film are placed around the load and a pallet carrying the load to form a unitized package. The trailing end of the film web is then severed from the dispensing roll by the operator and sealed to the underlying film wrap. The package is carried out by the fork truck, removed from the tines of the truck and deposited in a storage area.

U.S. Pat. No. 4,050,220 discloses a wrapping device for multiple unit loads. Each load is conveyed to a wrapping area in which a load is supported on one or more stationary planar surfaces. The leading edge of a roll of stretchable plastic wrapping material is held adjacent to the load, and the roll of material is rotated on a ring mechanism about the load and the supporting planar surfaces, wrapping the load and the supporting surfaces together. The plastic wrapping material is stretched during the wrapping operation so that the material is placed under tension and stretched as applied to the load. After the wrapping cycle is complete, the wrapped load is pushed past the end of the supporting surfaces, and the wrapping material which originally covered the supporting surfaces collapses against the formerly supported side or sides of the load. Additional developments of ring driven wrapping systems are disclosed in U.S. Pat. Nos. 4,109,445; 4,110,957 and 4,178,734.

Another patent of interest, U.S. Pat. No. 4,226,397, a division of an application which issued into U.S. Pat. No. 4,166,348, is directed to a small package wrapping apparatus in which a driven rotatable disc is mounted on an upstanding frame. An independently driven package support mechanism is mounted on the rotatable disc along with another independently driven film dispenser mechanism. The film dispenser mechanism and support mechanism are rotated with planetary gearing keyed to the disc drive.

When the disc is rotated by the main drive assembly, the package support mechanism is rotated independently so that the upper surfaces of its supporting sections will at all times be maintained in a horizontal plane.

It can thus be seen that this apparatus, while adapted to hold and wrap small packages and loads, is constructed with very complex counter-rotating drive mechanisms causing relative rotation of the main disc, load support mechanism and dispenser mechanism.

Because of the nature of its complex construction, it is difficult to hold the film web during the start of the wrap requiring a mechanical tie to the load. Since the support mechanism moves, it is very difficult to support multiple units of irregular configuration such as a number of logs. Furthermore, the apparatus also suffers from not having a load hold down or clamping capacity.

Commercial circular rotating wrapping machines are presently manufactured by Lantech Inc. under the trademark LANRINGER and are provided with wrapping rings having inner diameters of thirty six inches, fifty four inches, seventy two inches and eighty four inches. The roll of stretch material is carried on these wrapping rings. In differentiating between these various circular rotating wrapping machines manufactured by Lantech Inc., the manual model has the designation "SR", the full web models have the designations "SVR" and "SAVR", the multiple banding models have the designation "SVBR" and "SAVBR", the spiral models have the designation "SVSR" and "SAVSR", and the continuous wrap or bundler models have the model designations "SVCR" and "SAVCR".

In these commercial machines, the load is pushed from a conveyor onto support tongues or wrapping rails and the load and support tongues are wrapped by a supply of stretch film carried by the wrapping ring.

The film is stretched as it is rotated from the dispenser and the stretched film holds the load together under compressive forces and also engages the tongues or wrapping rails on which the load is supported. The load is then pushed or carried off of the tongues by the following load or a take off conveyor. Alternately, the load as it is fed into the rotating wrapping apparatus is carried through the wrapping station by a conveyor assembly having an upper conveyor which carries the load in a downstream direction and a lower conveyor mounted under the load carrying conveyor. The lower portion of the endless belt of the lower conveyor travels at the same speed and in the same direction as the upper portion of the endless belt of the load carrying conveyor so that stretched film wrapped around the load and conveyor assembly is carried by the lower conveyor at the same speed and in the same direction as the load is carried by the upper conveyor.

As previously noted, the popularity in the use of stretched plastic film for wrapping loads occurs because the elasticity of the stretched plastic film on the products of the load holds the load under more tension than either shrink wrap or kraft wrap, particularly with products which settle when packaged. The effectiveness of stretched plastic film in holding a load together is a function of the containment or stretch force being placed on the load, and the ultimate strength of the total layered film wrap. These two functions are determined by the modulus, or hadrness, of the film after stretch has occurred and the ultimate strength of the film after application.

Generally speaking, the aforementioned commercial wrapping machines are generally not susceptible for use by operators who are interested only in the manual wrapping of small loads, without the need of expensive automatic apparatus.

It can thus be seen that there is a need for a simply constructed, manually operated apparatus which is provided with a stable wrapping platform. The apparatus should be constructed to allow an operator to reach into the wrapping area without fear of injury, have relatively few maintenance and replacement problems, and be easily operated by relatively unskilled personnel.

SUMMARY OF THE INVENTION

The present invention is directed toward a simply constructed, sturdily built apparatus for applying stretchable plastic film to small, manually moveable loads for containment of those loads. The invention uses a prestretching mechanism in the form of two connected rollers driven by the film web at different speeds to elongate the plastic film between the connected rollers as the film is wrapped around a stationary load.

The present invention thus specifically discloses an apparatus which prestretches the film before wrapping the film around the load so that the film may be elongated, if desired, beyond its yield point before it is wrapped around the load thus holding the load under compressive force. The film is stretched between an upstream roller driven at a slower speed than the downstream roller through the use of a drive member having a diameter significantly greater than that of the downstream roller. The drive member is mounted on the shaft of the upstream roller or, alternatively, to the upstream roller itself, and as the shaft or roller turns, the drive member also turns with its surface engaging the surface of the downstream roller. This causes the upstream roller to rotate at a slower speed than that of the downstream roller thus stretching the film web between the rollers.

Most plastic films when stretched above their yield point gain significantly in modulus and ultimate strength. The typical polyethylene film will multiply three times the ultimate strength in pounds per square inch (psi) of cross sectional area after being elongated approximately three hundred percent. This significant increase in strength begins approximately when the yield point is exceeded in the elongation phase. When higher film elongation levels are achieved, the invention thus requires fewer revolutions of film for equivalent load holding forces. These higher levels of stretch not only allow fewer revolutions of film but also uses less film by weight for each revolution.

Thus, the present invention allows at least twice the practical level of elongation currently experienced with prior art brake systems. This gives higher containment force or lower film costs to the end user.

Furthermore, the invention allows for precise control of elongation allowing the user to obtain maximum cost efficiency from the new high yield films, along with higher film strength or modulus achieved at higher levels of elongation.

The higher levels of elongation are achieved in the film without disruptive or crushing forces on the load because of the mechanical advantage experienced between the pulling force to the load and the force between the rollers.

The novel construction of the invention thus provides for isolation of the film roll from film forces which eliminates premature film failure from roll end damage or roll down of edges under force. The use of a simplified construction by placing a drive roller on the upstream roller shaft to engage and drive the upstream roller at a lower speed than that of the downstream roller eliminates the use of friction brakes and the problems of those brakes such as speed variation, friction break-away from a stopped position, temperature variation, wear and operator control meddling.

In addition, relative motion of the parts of the apparatus is contained and simplified by having only a rotating arm which rotates around the stationary carriage. The carriage also has support plates which extend outward toward the user allowing the user to easily place the load on the support plates for easy wrapping access and removal of the wrapped package without the need to use heavy equipment or additional costly machinery. It can also be seen that a user or an operator can place his or her hands inside the wrapping area while the package is being wrapped with no chance of injury, thus providing a significant safety feature in the wrapping operation, as well as providing operator confidence and increasing package wrapping speed.

The present invention also provides a unique apparatus in that the two rollers are mechanically interconnected by a drive roller which causes a speed differential on the film driving the rollers causing it to be stretched before it is applied to the load. A mechanical advantage is obtained allowing stretch during the pulling action and a slight strain recovery after the pulling action is effected when the film is stretched above the yield point. Minimum frictional force is placed on the film after it leaves the rollers and is wrapped around the load. The present invention essentially eliminates the neckdown of the film web normally experienced at high elongation rates by limiting the stretching action to a minimum distance between the upstream and downstream rollers and avoiding secondary stretch between the downstream roller and the load.

The driving forces obtained by placing the upstream and downstream rollers closely together and rotating the rollers in opposite directions allow the high rate of stretch between the rollers.

In addition, the use of two concentric shafts, one of which extends through the drive shaft and supports the carriage in a fixed stationary position, the other rotating around the fixed shaft and driving the dispensing arm around the load allows wrapping of the load without using a ring mechanism providing a sturdy, maintenance-free construction.

This stationary support allows irregular, round or cylindrical units to be easily supported during wrapping. The leading end of the web is clamped to the upper surface of the load eliminating mechanical ties to hold the film to the load. The moveable top clamp plates provide additional stability to the load, allowing easier uniform wrapping unlike that of prior art devices.

With these and other objects, the features and advantages of the invention will become apparent from the following more detailed description of a preferred embodiment of the invention as illustrated in the accompanying drawings.

BRIEF DESCRIPTION OF THE DRAWINGS

FIG. 1 is a top plan view of the inventive wrapping apparatus;

FIG. 2 is an isolated side elevational view of the drive assembly apparatus shown in FIG. 1;

FIG. 3 is an enlarged isolated front elevational view of the stretching mechanism with rollers apart to provide an untensioned wrap portion;

FIG. 4 is a sequential view of the stretching mechanism of FIG. 3 with the rollers engaging to provide a tensioned stretched wrap portion;

FIG. 5 is a front elevational view of the wrapping apparatus shown in FIG. 1;

DETAILED DESCRIPTION OF THE DRAWINGS

The present invention pertains to a rotatable wrapping apparatus 10 as illustrated in FIGS. 1 through 10. The preferred embodiment and best mode of the invention is illustrated by these same figures.

Figure 6:
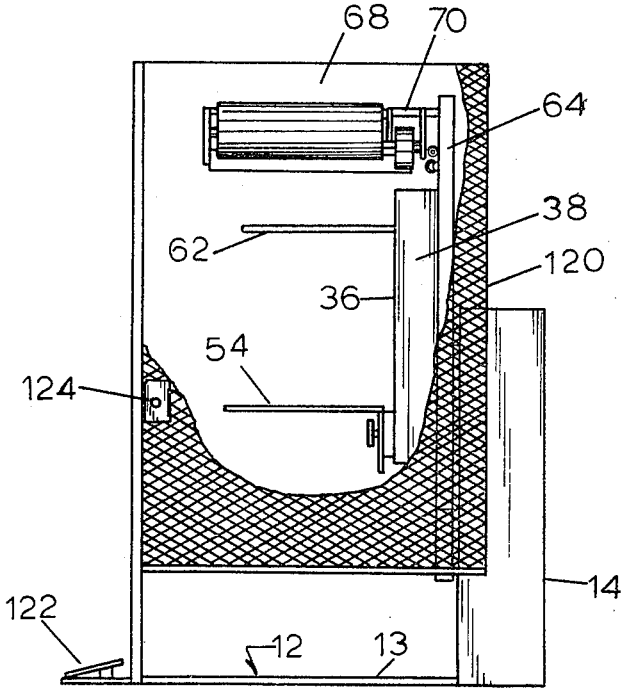
FIG. 6 is a side elevational view of the wrapping apparatus shown in FIG. 5 with a protective cage partially broken away to disclose the wrapping mechanism of the apparatus.

The wrapping apparatus 10 as best seen in FIGS. 1, 5 and 6 is constructed with a base 12 on which a frame or stand 14 is secured. The base 12 preferably comprises two linear members 13 on which the stand 14 is welded. The stand 14 is constructed of a front panel, side panels, a top panel and a bottom panel, and a removable rear panel. The rear panel covers a drive assembly 16 for safety reasons and can be easily removed to allow maintenance, if desired. All of the panels, with the exception of the rear panel, are preferably welded together to form a rectangular housing for the drive assembly. The drive assembly 16, as more clearly illustrated in FIG. 2, is mounted inside the stand with conventional fasteners and comprises a standard three-quarter horsepower motor 18 which is a standard stock item utilizing a 120 volt power source.

A hollow stationary throughgoing tubular support shaft 20 extends from the drive assembly 16 through the front panel of the stand. A brace member 24 is secured to the hollow stationary support shaft and to the frame 14 to prevent any rotation of shaft 20. A rotatable outer shaft 26 is mounted in pillow block support bearings 27 mounted to the stand 14. Stationary support shaft 20 can be greased to allow rotatable shaft 26 to easily rotate over its outer surface or the ends of shaft 26 can be provided with bushings or sleeve bearings 29 to provide for easy rotation of the shaft. A grease nipple 31 is provided in shaft 26 to allow grease to be inserted into the chamber formed between the concentric shafts.

Optionally, the apparatus can have a pneumatically operated clamp or top plate(s) 62. In such a modification, a plurality of air lines 22 are run through hollow shaft 20. The air lines 22 are connected to a pneumatic cylinder 56, and have distal ends provided with quick disconnects 23 which can be easily hooked up with standard known in the art feed lines connected to an air reservoir.

A sprocket 28 is secured to the rotatable shaft 26 and is contained within the housing of the stand. A drive sprocket 32 is secured to a reducer shaft 34 which is driven by the motor 18 through a reducer box 19 as is well known in the art. An endless chain 30 is mounted around sprockets 28,32 so that rotation of the reducer shaft 34 will rotate drive sprocket 32 and driven sprocket 28 causing the outer shaft 26 to rotate around support shaft 20.

A load support carriage 36 is mounted on the outer side of the front panel of the frame 14 by welding the same to the fixed shaft 20. The carriage 36 is formed with a substantially "C-shaped" frame formed by a center section 38 and integral legs 39. The legs 39 are formed with outwardly beveled edges 40. A pair of parallel rods 42 forming a track are secured to the center section 38 by welding end blocks 43 secured to the ends of rods 42 onto the carriage center section. A track follower assembly 44 is mounted on the rod members 42 for movement thereon. The track follower assembly 44 is constructed with a pair of C-shaped guide members 45 having legs 46, each of which is provided with a sleeve member 47. A lower brace member 48 is secured to and connects the guide members 45 with upper clamp support member 50 also connecting and being secured to the guide members 45. The sleeve members 47 of the guide members are provided with axially coaligned apertures allowing easy transportation of the guide members along track rods 42. The carriage is formed with a lower moveable support cross member 52 which is adjustably mounted to beveled edges 40. The cross member 52 extends beyond the beveled edges 40 and is provided with end structures which engage the beveled edges to form tracks on which the cross support member can ride vertically. Handles 53 are threadably mounted on the ends of the cross support member to tighten or lock the cross member in place on the carriage. The handles can be loosened to manually move the cross support member 52 vertically to another position on the carriage. The cross support member is provided with two support plates 54 which are adjustably mounted on the cross support member 52 so that they slidably move along the cross member to vary the spacing between each plate. Each support plate 54 is provided with a locking handle 55 to lock it into place on the cross member. An upper clamp and platen plate(s) 62 is removably mounted on the upper clamp support member 50. The upper clamp support member can be moved by manual or automatic means. When the automatic mode is selected, it is accomplished through the use of a pneumatic cylinder 56 secured to the carriage center section 38. The pneumatic cylinder 56 is activated by air lines 22 which are connected to the pneumatic cylinder 56 and an air source (not shown) through the hollow support shaft 20. Such a connection is well known and standard in the art. The cylinder piston rod 58 has a yoke member 60 secured to brace 48 which is secured to and extends between the guide members 45. Thus, it is seen that movement of rod 58 carries the follower assembly 44 along rods 42.

Mounted behind the carriage 36 and secured to the outer shaft 26 is a rotating arm 64 constructed with a counterbalance weight 66 on one end and a film stretching assembly 68 on the other end.

The film stretching assembly 68 comprises a cylindrical support rod 70 secured to the arm 64, a film roll support member 72 secured to a bracket 73 which is in turn secured to arm 64 and a stretching mechanism 74 moveably mounted to the support rod 70.

The film roll support member 72 is constructed with a mandrel shaft which is adapted to hold a film roll 80. The film stretching mechanism 74 comprises a first rotatable bracket member 82 mounted on support rod 70 which supports a rotatable downstream roller member 84 and a second bracket member 92 mounted on support rod 70 which supports a rotatable upstream roller member 96. The roller members (84, 96 and 98) surfaces have a high coefficient of friction and are preferably molded or rubber covered. The downstream roller member 84 is mounted on a shaft 85 which is journalled as is well known in the art in legs 83 of the bracket member 82. The downstream roller member 84 is biased toward the upstream roller 96 by a coil spring 86 which has one end secured to a spring plate 88 mounted to the interior leg 83(*a*) and the other end secured to a spring mount 90 mounted or secured to arm 64. The spring 86 biases the bracket 82 so that the downstream roller member 84 engages the surface of the drive roller member 98 mounted in second bracket member 92 unless a gravity activated disengagement switch member 106 is utilized to separate the roller surfaces.

The second rotatable bracket member 92 rotatably supports a shaft 94 journalled in legs 95 of the bracket member, upon which are mounted upstream roller member 96 and a drive roller member 98. The drive roller member 98 and upstream roller member 92 are biased toward the roll support by a second coil spring 102 which has one end secured to a spring plate 104 secured to the interior leg 95(*a*) and the other end secured to spring mount 90 secured to the arm 64.

The manual gravity switch member 106 comprises a handle member 108 which is pivotally mounted at 110 on a support plate 112 secured to leg 83 of bracket 82. The handle member 108 is provided with a cam pin 109. When the handle is pivoted to assume the position shown in FIG. 3 the cam pin 109 engages the outer surface of leg 95 of the upstream roller bracket 92 camming bracket 82 against the bias of spring 86 to separate the downstream roller member 84 from the drive roller member 98.

When arm 64 is rotated, the gravitational pull causes handle 108 to drop down into the position shown in FIG. 4 releasing the force of the handle on the spring 86 and allowing the spring to bias the roller members (84,98) together. When the roller members 84 and 98 engage, the roller 96 is slowed with respect to roller 84 allowing the web of film to be stretched to the desired degree between the upstream roller 96 and the downstream roller 84. The degree of stretch will be determined by the diameter of the drive roller 98, the diameter of the downstream roller 84 and the diameter of the upstream roller 96. It should be noted that drive roller 98 is removable and can be easily replaced in any one of a number of varying diameters so that the predetermined stretch differentials of the film web can be obtained. The downstream roller 84 is also removable and can also be easily replaced to infinitely vary the percentages of stretch which can be obtained.

Alternately, each of the roller members 84 and 96 can be molded with internal splines adapted to mate with and be fixedly held to external splines molded onto a hub of the drive roller 98 which fits into the mandrel of the roller member. This construction precludes the necessity of mounting the driver member to the upstream roller shaft. Since both ends of the roller members 84,96 are splined, drive members can be mounted on both ends, or a cap placed on one end of the roller member and a drive member on the other.

The entire apparatus is surrounded by a protective cage 120 as shown in FIG. 6. A foot pedal 122 is positioned outside of the cage to activate the motor 18 to begin the wrapping process and a switch 124 is mounted on the cage 120 which allows the operator to activate the pneumatic cylinder 56 moving the upper support plate(s) 62 toward or away from the load. At the beginning of the wrap, the plate 62 acts as a top platen holding the leading end 101 of the film web against the load and stabilizing the load during the wrapping process.

Figure 7:
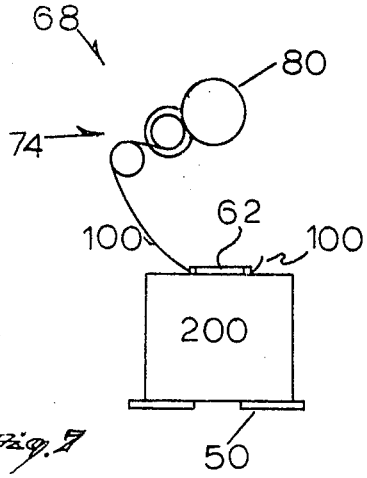
FIG. 7 is a schematic view of the wrapping mechanism beginning the wrap around the supported load.
Figure 8:
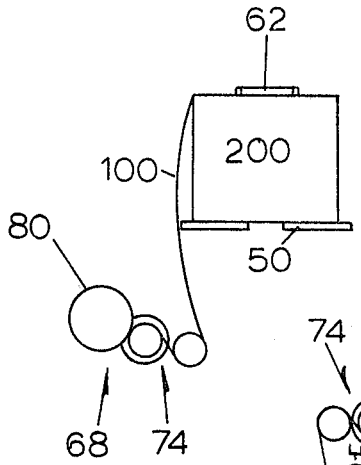
FIG. 8 is a sequential schematic view of the wrapping mechanism as shown in FIG. 7 with one quarter of the wrap completed.
Figure 9:
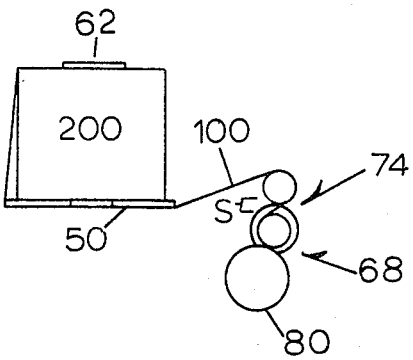
FIG. 9 is a sequential schematic view of the wrap shown in FIG. 8 with approximately three quarters of the wrap completed.
Figure 10:
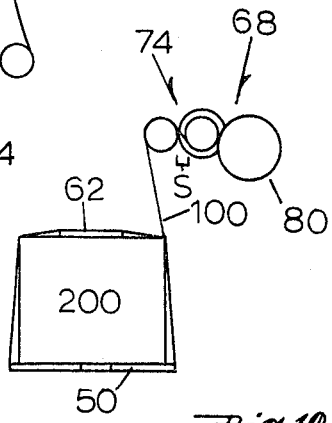
FIG. 10 is a sequential schematic view of the wrap shown in FIG. 9 with at least one complete wrap placed around the supported load.

In the operation of the apparatus, the arm 64 is rotated to a stopping point so that the stretching mechanism 74 and web roll 80 are positioned above the load as shown in FIG. 6. The operator then grabs handle 108 and rotates the handle as is shown in FIG. 3 with cam pin 109 engaging bracket member 92 to transport bracket member 82 and its downstream roller 84 against the bias of spring 86 and separate the downstream roller 84 from the driver roller 98. The leading end 101 of the film web 100 is pulled from roll 80 through rollers 84 and 96 and placed on top of load 200 as is best seen in FIG. 7. The rollers 84 and 96 rotate in opposite directions as the film web 100 is pulled past them. The load 200 was previously manually placed by the operator on the support plates 54. The operator then activates switch 124 to force pneumatic cylinder 56 and cross bar 60 with its associated support plate 62 downward so that the end 101 of the web is firmly held between the bottom surface of plate 62 and the top surface of the load 200. The operator presses foot pedal 122 which actuates the motor 18 turning sprocket 28 and its associated shaft 26 so that the arm 64 is rotated around the load. Both the activation of the pneumatic cylinder and motor are accomplished by standard well known state of the art circuitry. As the stretching mechanism is rotated around the second corner of the load as shown in FIG. 8, the web pulled from the film roll 80 is still untensioned as cam pin 109 has overcome the bias of spring 86 so that drive roller 98 does not engage the roller surface of downstream roller 84. After the roll 80 has passed the second corner and is positioned beneath the load 200, gravity causes the handle mechanism 106 to fall downward releasing the cam pin 109 as is shown in FIG. 4. The release of the cam pin 109 allows spring 86 to bias the downstream roller 84 inwardly toward the drive roller 98 so that the outer surface of drive roller 98 engages the outer surface of downstream roller 84 driving the roll surface of the upstream roller at a speed proportional to the diameters of the respective rollers. Drive roller member 98 is removably mounted to shaft 94 and can be replaced by other variably sized drive rollers allowing a relationship from thirty percent to three hundred percent to allow use of all stretch films which are currently available in the marketplace. It should be noted at this time that roller 96 is turning at the same speed as is drive roller 98 since both of the rollers are mounted on shaft 94. Roller member 96 is driven at a much lower speed than roller 84 causing the film web to stretch in the space S between roller 96 and roller 84.

As shown in FIGS. 1 and 3 through 6, the film is thereby precisely elongated by a percentage represented by the relative speed differential of the rollers 96 and 84. Thus, the film is held at a constant tension level for a period beginning with contact of the film on the second or downstream roller member 84 and ending when the film leaves contact with the second roller and moves toward the load 200. During this period, the strain achieved during the film elongation beyond the yield point is allowed to take a partial set and realize a high effective modulus.

As the film leaves the downstream roller member 84, it normally experiences a stress reduction because of the mechanical advantage over the pulling action represented by the speed difference of the rollers less any friction in the film unwind and roller system. This stress reduction causes inelastic strain recovery because the film was originally elongated beyond the yield point. When the apparatus is relatively friction-free, meaning that the friction force is less than ten percent of the force required to elongate the film, substantially all of the elongation occurs between the two closely spaced roller members 84 and 96.

The rollers 96 and 84 are closely spaced apart within a range of one eighth of an inch to seven inches or with a preferred closer controlled range of one quarter inch to two inches, and are rubber faced for maximum film contact. The close spaced relationship of the rollers prevents significant neckdown of the film.

As the web 100 is being stretched, it is wrapped around the load 200 by the rotation of arm 64 carrying the stretching mechanism 74 around the load 200 and covering the load with a number of stretched wraps of material. When a predetermined number of wraps are completed to sufficiently wrap the load, which number can be determined by the operator or through the use of a counting switch, sensor, or any other circuitry which is well known and used in the art, the film roll 80 and the film stretching mechanism 74 are positioned above the load in a stationary position. The operator then severs the web between the load 200 and roll 84 and fastens the trailing edge of the web down onto the next underlying web layer by smoothing the web onto the underlying film web layer with his or her hand. The operator then activates switch 124 so that the plate 62 is lifted upward from the load one quarter of an inch to one inch, thus allowing the wrapped package to be easily pulled off of the plates 62 and 54 and deposited on a loading conveyor or placed in another area adapted to receive the wrapped packages.

Films which can be used in the present invention are EVA copolymer films of high EVA content such as the film manufactured by Consolidated Thermoplastics "RS-50" and PPD "Stay-Tight"; PVC films such as Borden Resinite "PS-26" and premium films such as Mobil-X, Presto SG-4 and Bemis.

Thus, it can be seen that the apparatus for elongating plastic film to overwrap products for containment using a film driven prestretch mechanism with a mechanical advantage provides a significant improvement over the prior art. The pulling action elongates the film between the two rollers connected by the drive roller to rotate at different speeds and isolates the elongation action from the film roll and the load. The mechanical advantage allows very high stretching levels to be achieved. It should be noted that the yield point of a film is substantially defined by the tensile yield of the stretch film being used. The tensile yield under ASTM Test Method D-882 for Mobil-X film is 980 psi; Mobil-H film 1000 psi; and Mobil-C film 100 psi. The force required to reach the yield point prior to stretching for a given film web is found by the formula:

$$\text{cross sectional area} \times \text{tensile yield} = \text{force at yield point}$$

As an example, the yield point of a 20 inch$\times$0.0009 inch web of Mobil-X film would therefore be 17.6 pounds before it is prestretched.

The common tests used to determine tensile yield are the ASTM D-882 and ASTM D-638.

The film forces placed on the load allow the overwrapping of the product at high levels of elongation without disruptive or crushing forces which would be incurred at equivalent levels of elongation using conventional brake-type film stretch systems.

In the foregoing description, the invention has been described with reference to a particular preferred embodiment, although it is to be understood that the specific details shown are merely illustrative and the invention may be carried out in other ways without departing from the true spirit and scope of the appended claims.

What is claimed is:

1. Apparatus for making a unitary package using a single web of stretchable plastic film material to form an overwrap comprising a frame, a load support means and a film dispensing means connected to said frame, said film dispenser means being adapted to hold a film roll and said load support means being adapted to hold a load, means to provide relative rotational movement between said load support means and said film dispenser means causing a film web to be pulled downstream from the film roll and wrapped around a load placed on said load support means, and film stretching means engaging said film web from said film roll upstream of said load support means; said film stretching means being driven by engagement of said film web moving downstream and comprising means to hold two roller assemblies adjacent each other, each roller assembly comprising bearing means and a roller member mounted to said bearing means, one of said roller assemblies being positioned upstream from the other roller assembly and including a drive roller member mounted to rotate coaxially with said upstream roller, said drive roller member having a circular cross-section and an outer surface which engages a surface of the downstream roller assembly to drive the upstream roller at a lesser speed than the rotational speed of the downstream roller so that the film web is stretched before it passes the downstream roller assembly.

2. Apparatus as claimed in claim 1 wherein said load support means comprises a shaft member connected to said frame in a substantially stationary position, a drive shaft coaxially aligned with said shaft member, and a load carriage fixedly secured to said shaft member.

3. Apparatus as claimed in claim 1 wherein said drive roller has a larger diameter than the diameter of the downstream roller.

4. Apparatus as claimed in claim 1 including disengagement means adapted to selectively disengage said drive roller member from contact with said downstream roller member.

5. Apparatus for making a unitary package using a single web of stretchable plastic film material to form an overwrap comprising a frame, support means connected to said frame, a load support means stationarily mounted to said support means, dispenser means movably mounted to said support means, said dispenser means being adapted to hold a roll of stretchable material placed thereon and dispense material in a downstream direction toward and around said load support means, film stretching means positioned downstream from said dispenser means adapted to receive stretchable material pulled from said dispenser means, said film stretching means comprising at least two closely spaced apart roller assemblies comprising a downstream roller assembly and an upstream roller assembly, each roller assembly comprising bearing means and a roller member mounted to said bearing means, one of said roller assemblies also including a drive roller means which engages a surface of said downstream roller assembly to drive said roller members at different speeds, said at least two closely spaced apart roller assemblies being mechanically interconnected to said drive roller means and driven by engagement of the film web pulled from the dispenser means as material is wrapped around the load so that the downstream roller member transports the film web faster than the upstream roller member to cause the material to elongate between the roller members before the film passes the downstream roller allowing stretched film to be placed around the load to hold it under compressive force.

6. Apparatus as claimed in claim 5 including means to selectively disengage said downstream roller assembly from the surface of said drive roller means allowing a length of film to pass through said upstream and downstream roller assemblies in a substantially unstretched state.

7. Apparatus as claimed in claim 5 wherein said film web is stretched past its yield point between said upstream roller assembly and said downstream roller assembly.

8. Apparatus as claimed in claim 5 wherein said dispenser means comprises an arm, a counterbalance weight mounted on one end of said arm, and a film roll holder mounted on the other end of said arm.

9. Apparatus as claimed in claim 5 wherein said rotatable shaft is mounted and supported by bearing means mounted to said frame.

10. Apparatus as claimed in claim 5 wherein said support means comprises a fixed shaft and a rotatable shaft mounted around said fixed shaft, and wherein said rotatable shaft is provided with a grease nipple allowing insertion of grease into the chamber formed between the inner surface of said rotatable shaft and the outer surface of said fixed shaft.

11. Apparatus as claimed in claim 10 including bushing means between said fixed shaft and said rotatable shaft.

12. An apparatus for making a unitary package using a single web of stretchable plastic film material to form the overwrap comprising a frame, shaft means extending from said frame, said shaft means including a fixed shaft extending from said frame, a stationary carriage adapted to support a load mounted on said fixed shaft, a rotatable dispensing means connected to said frame, said dispensing means being adapted to hold a roll of stretchable material and dispense a web of material in a downstream direction from the roll of stretchable material to and around a load held by said carriage, drive means mounted to said frame, said drive means being connected to said dispensing means and adapted to rotate said dispensing means around said carriage, film elongation means mounted to said dispensing means adapted to receive stretchable material pulled from said dispensing means, said film elongation means comprising at least a mechanical interconnection and upstream and downstream rotatable roller means closely spaced apart in a range of from one eighth of an inch to seven inches, said rotatable roller means being driven by engagement of the moving film web attached to the load and being pulled from the dispenser means as the dispensing means rotates around the load, wrapping the load, the downstream roller means being engaged by the mechanical interconnection so that the upstream roller means transports the film web slower than said downstream roller means to cause the material to elongate before it passes th downstream roller means.

13. Apparatus as claimed in claim 12 wherein said carriage means comprises a support assembly and a plurality of moveable support plates extending from said support assembly.

14. Apparatus as claimed in claim 12 wherein said dispensing means comprises a shaft rotatably mounted to and supported by said frame, an arm fixedly mounted to said rotatable shaft, a film roll holder mounted on one end of said arm, and counterbalance means mounted on the other end of said arm.

15. Apparatus as claimed in claim 14 wherein said film elongation means comprises a shaft extending from said arm, a first bracket member rotatably mounted on said shaft, a downstream roller means rotatably mounted in said bracket means, a second bracket means mounted to said shaft, an upstream roller means rotatably mounted in said second bracket member, and wherein said mechanical interconnection comprises a drive roller mounted to said upstream roller means engaging said downstream roller means.

16. Apparatus as claimed in claim 15 wherein said drive roller is coaxially mounted to said upstream roller member, said drive roller having a diameter greater than the roller diameter of said upstream roller member and the roller diameter of said downstream roller member.

17. Apparatus as claimed in claim 16 including means to adjustably engage and disengage said downstream roller from said drive roller.

18. Apparatus as claimed in claim 17 wherein said engagement and disengagement means comprises a pivotable handle member mounted to said downstream roller bracket, said pivotable handle member being provided with cam means adapted to extend the downstream roller surface away from the drive roller surface so that there is no contact between the surfaces.

19. Apparatus as claimed in claim 11 including pneumatic cylinder means mounted to said carriage, said pneumatic cylinder means being adapted to selectively move an assembly mounted to said carriage.

20. Apparatus as claimed in claim 12 wherein said mechanical interconnection comprises a drive roller mounted to said upstream roller member.

21. Apparatus as claimed in claim 12 wherein said shaft means includes a rotatable shaft rotatable around the surface of said fixed shaft means.

22. Apparatus as claimed in claim 12 including remote switch means connected to said drive means adapted to energize said drive means.

23. Apparatus as claimed in claim 19 including switch means connected to said pneumatic cylinder means adapted to selectively energize said pneumatic cylinder means allowing a piston rod to assume a plurality of positions.

24. Apparatus as claimed in claim 12 wherein said carriage means comprises a support member, a load support member removably mounted to said support member, a plurality of track members mounted to said support member and a cross member mounted on said track members.

25. Apparatus as claimed in claim 24 including a plurality of removable support plates mounted to said carriage means, each support plate comprising a base member and a support leg extending outwardly from said base member.

26. An apparatus for making a unitary package from a load using a single web of stretchable package material to form an overwrap comprising a frame, support means extending from said frame, film dispenser means rotatably mounted to said support means, said film dispenser means being adapted to hold a stretchable plastic film material and dispense the material, said film dispenser means comprising an arm member having first and second ends, a counterbalance means mounted to said first end of said arm member, film stretching means mounted on the second end of said arm member, a roll of stretchable plastic material mounted to said second end of said arm member, drive means connected to said film dispensing means to rotate said dispensing means, and a load support assembly fixedly mounted to said support means, said film stretching means being adapted to receive and to be driven by engagement of stretchable plastic material being pulled downstream from said roll of stretchable plastic material by rotation of said dispensing means and stretch said material, said stretching means comprising two roller assemblies, each assembly including a rotatable roller, one of said rollers being driven by stretch control means mounted on one of said roller assemblies, said stretch control means being removable and comprising a roller member which is coaxially aligned with the upstream roller to engage the downstream roller driving the upstream roller slower than the downstream roller causing plastic film material which is being pulled from the dispensing means by rotation of the dispensing means to be wrapped around a load carried on said load support assembly with a plurality of layers of prestretched plastic material stretched beyond its yield point to form a wrapped tensioned unitary package.

27. Apparatus as claimed in calim 26 including means connected to one of said roller assemblies adapted to move one of said roller assemblies out of engagement with said roller member so that film being pulled therethrough by rotation of the dispenser means around the load is substantially untensioned.

28. Apparatus for making a unitary package from a load using a single web of stretchable plastic material to form the overwrap comprising a frame, connection means extending from said frame, said connection means comprising a fixed tubular member connected to said frame to hold said fixed tubular member in a stationary position, and a rotatable tubular member having first and second ends and being supported by bearing means at said first end mounted to said frame adapted to rotate around the fixed tubular member, a carriage assembly adapted to hold a load secured to said fixed tubular member means, drive means mounted to said frame adapted to engage said rotatable tubular member to rotate said rotatable tubular member on said bearing means, film dispensing means mounted to the second end of said rotatable tubular member comprising an arm member having first and second ends, a film roll support means adapted to hold a film roll mounted to said first end of said arm member, film stretching means mounted adjacent said film roll support means on said arm member and a counterbalance means mounted on the second end of said arm member, said film stretching means being driven by engagement of the moving film web attached to the load and pulled from the dispenser means in a downstream direction by rotating the dispensing means around the load and comprising closely spaced apart upstream and downstream rollers interconnected by mechanical connection means so that the downstream roller transports the film web at a faster rate of speed than the upstream roller to cause the film web to elongate before the film web passes the downstream roller.

29. Apparatus as claimed in claim 28 wherein said carriage assembly comprises a support frame and a plurality of support plates movably mounted on said support frame.

30. Apparatus as claimed in claim 28 including fluid cylinder means mounted to said carriage assembly frame, said fluid cylinder means connected to a track follower assembly movably mounted on track means secured to said frame to move said track follower assembly upon energization by an operator, said fluid cylinder means being energized by fluid passing through lines which run through the interior of the fixed shaft of said connection means to a fluid supply source.

31. Apparatus as claimed in claim 30 including clamp plate means which extends outwardly from said track follower assembly.

32. Apparatus as claimed in claim 28 wherein said film stretching means comprises a support shaft secured to said arm, first bracket means rotatably mounted to said shaft, a downstream roller assembly including a roller member mounted on said bracket means and spring means mounted to said bracket means and a support secured to said arm biasing said bracket means inward towards an upstream roller assembly, a second bracket means mounted on said support shaft, an upstream roller assembly rotatably mounted in said bracket member, said upstream roller assembly including a shaft, an upstream roller member mounted to said shaft and a drive roller member coaxially aligned with said upstream roller member, said drive roller member being of a diameter greater than the diameter of the downstream roller member and adapted to engage and drive said upstream roller member when film from said film roll is pulled through said stretching mechanism.

33. Apparatus as claimed in claim 30 wherein said carriage frame has outwardly turned beveled edges and a cross member moveably mounted to said beveled edges, and means to selectively secure said cross member in a number of preselected positions to said beveled edges.

* * * * *